United States Patent [19]

Honjo

[11] 4,142,358

[45] Mar. 6, 1979

[54] YARN ENDING UNIT FOR OPEN-END SPINNING MACHINE

[75] Inventor: Takeshige Honjo, Suitashi, Japan

[73] Assignee: Murata Kikai Kabushiki Kaisha, Japan

[21] Appl. No.: 819,031

[22] Filed: Jul. 25, 1977

Related U.S. Application Data

[63] Continuation of Ser. No. 708,436, Jul. 26, 1976, abandoned, which is a continuation of Ser. No. 507,056, Sep. 18, 1974, abandoned.

[51] Int. Cl.[2] ..... D01H 15/00

[52] U.S. Cl. ..... 57/263; 57/58.89

[58] Field of Search ..... 57/58.89, 34 R

[56] References Cited

U.S. PATENT DOCUMENTS

| | | | |
|---|---|---|---|
| 3,680,300 | 8/1972 | Landwehrkamp | 57/34 R |
| 3,810,352 | 5/1974 | Miyazaki et al. | 57/34 R |
| 3,877,210 | 4/1975 | Seidl | 57/34 R |
| 3,878,671 | 4/1975 | Seidl et al. | 57/34 R |
| 4,080,775 | 3/1978 | Stablecker | 57/34 R |

*Primary Examiner*—Charles Gorenstein
*Attorney, Agent, or Firm*—Whittemore, Hulbert & Belknap

[57] ABSTRACT

A yarn ending unit, applied to an open-end spinning machine, which performs ending by means of the ending unit running in front of said spinning machine. The ending unit includes a friction roller for driving a package unit and a friction roller for driving a feed roller, both fitted to said ending unit. The two friction on rollers are driven by a variable speed electric motor, the number of revolutions of which can be controlled in response to the number of revolutions of a rotor fitted to said spinning machine. A hook is provided for each spinning machine, to hold one end of a yarn, and said hook is designed to be operable by a solenoid, energized by output from the control means.

4 Claims, 7 Drawing Figures

YARN ENDING UNIT FOR OPEN-END SPINNING MACHINE

This is a continuation of application Ser. No. 708,436 filed July 26, 1976, abandoned, which is a continuation of Ser. No. 507,056, filed Sept. 18, 1974, now abandoned.

BACKGROUND OF THE PRESENT INVENTION

The present invention relates to a yarn ending unit in connection with an open-end spinning machine. There have been many cases in which full automation of machines has been discussed in a background of labor cost increase, however, there are also some inherent problems as to whether they are suited to manual operation or not. For example, some operations are not suitable for man such as a simple and repeated one, operation under high or low temperature circumstances, and operation requiring super high precision or at an extremely high speed, whereas an operation such as to untie tangled yarn is said to be too complicated for mechanization.

As one of the features of an open-end spinning machine, since one end of a yarn resulting from breakage causes a dough body-like coil due to hard twist of the yarn and arrives at this state as fast as a winding bobbin, a considerably complicated unit is required to provide an air suction to pick up the yarn, release the twist, tie the yarn, and return it into a spinner, whereas it is easy for a man or a woman to handle the end of a yarn and to tie it. However, it is very difficult for a man or woman to perform such an operation as to insert an end of a yarn into rotors at high speed revolution with good timing or to pull yarn out when an inserted end catches a new yarn, and it can be said that such an operation is suited to a machine. The basic idea of the present invention is: A man or a woman deals with the end of a yarn which has been cut, and a machine conducts its ending.

According to the present invention, ending operation is divided into two ranges; namely, the first operation includes the one in which an operator has prepared another string of yarn having been positioned at a different passway from the usual yarn running pass, and the second operation consists of the one in which a machine automatically starts up using a yarn end which was prepared by the operator and returns it to the usual running pass. If these two operations should all be carried out mechanically, the operations would be quite complex and would require a very expensive movable ending unit. It is quite natural to say that the present invention does not include a function in which the manual operation is replaced by a mechanism provided by a stationary side machine and which can return yarn placed at another passway to the usual yarn running pass.

Figure 5:
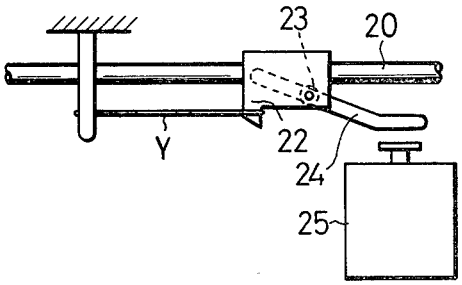
FIG. 5 is the plan of the portion to bend a yarn, also included in the present invention.
Figure 6:
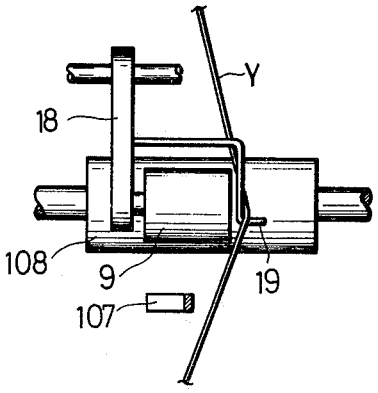
FIG. 6 is the plan of nip-rollers.

The present invention is hereinafter explained with reference to the drawings attached. An ending unit 202 travels back and forth continuously on rail 202 in front of open-end spinning machines 200 and stops just before the machine 200 in which a yarn is cut, when it is cut. Each spinning machine 200 is one widely known. A sliver S is fed by a feed roller 1, is opened by a combing roller 2, and is inserted onto a rotor R. The rotor R is rotating at a high speed, since its shaft 3 is supported by discs 4 and 5 and is connected with a belt 6 through a pulley 7, and spun-cut yarn Y is pulled out by a nip-roller 9 through a spinner 8, and is wound up by the bobbin B fitted to the cradle 12 while passing through the tension guide 10 and being traversed by the traverse roller 11. When a string of yarn is cut, it is detected by a feeler 13 resulting in disengagement of a clutch connecting the feed roller 1 with its power source and to turn ON an indicator light to indicate this fact. A traverse drum is continuously rotating, and an end of the yarn is wound up onto the bobbin B. An operator who learns of a yarn cut by the indicator light, lifts the cradle upward, removes the bobbin B from the drum, and engages a pawl 16, which is fitted to the pawl lever 15 and which has been displaced by a spring 14, with the pawl 17 of the cradle to let the bobbin be disengaged from the drum. The operator then pulls out the end of the yarn, which has already been wound on the bobbin, cuts the end and connects the yarn to a pin 19 provided on the cradle 18. Further, the operator hooks the yarn to the rod 20 fitted to the yarn bending unit, which is operated at the beginning and end of a spinning operation, and to a hook 22, which is provided in addition to hook 21, to which a yarn is to be hooked at the beginning and end of a spinning operation. A lever 24, which is energized in one direction by means of a tension spring 23 to remove the yarn is provided on the hook 22 and is designed to release the yarn hooked to the hook 22 when said lever 24 is swung clockwise by a solenoid 25 fitted to the movable ending unit, as shown in FIg. 5. It is natural, however, to be able to say that it is also possible to bend and release the yarn by providing a pin for the spinning machine at a location where the spinning machines can bend the yarn and by providing a swinging lever for the ending unit. The operator then cuts the end of the yarn to be easily inserted into a spinner at a length most suitable for ending of yarn with a scale provided for the machine, or cuts it to meet with a marked length fitted to the machine for this purpose, and inserts its end into the spinner 8. A most suitable length of a yarn in this case is, as is well known, a length at which an end of a yarn is most suitably inserted into the rotor when bending of the yarn about the hook 22 is released. Incidentally, it is desirable to provide a switch operable by foot in front of the machine to be able to stop the ending unit during operation, since the movable ending unit sometimes affects a danger to an operator while this operation is carried out.

Figure 2:
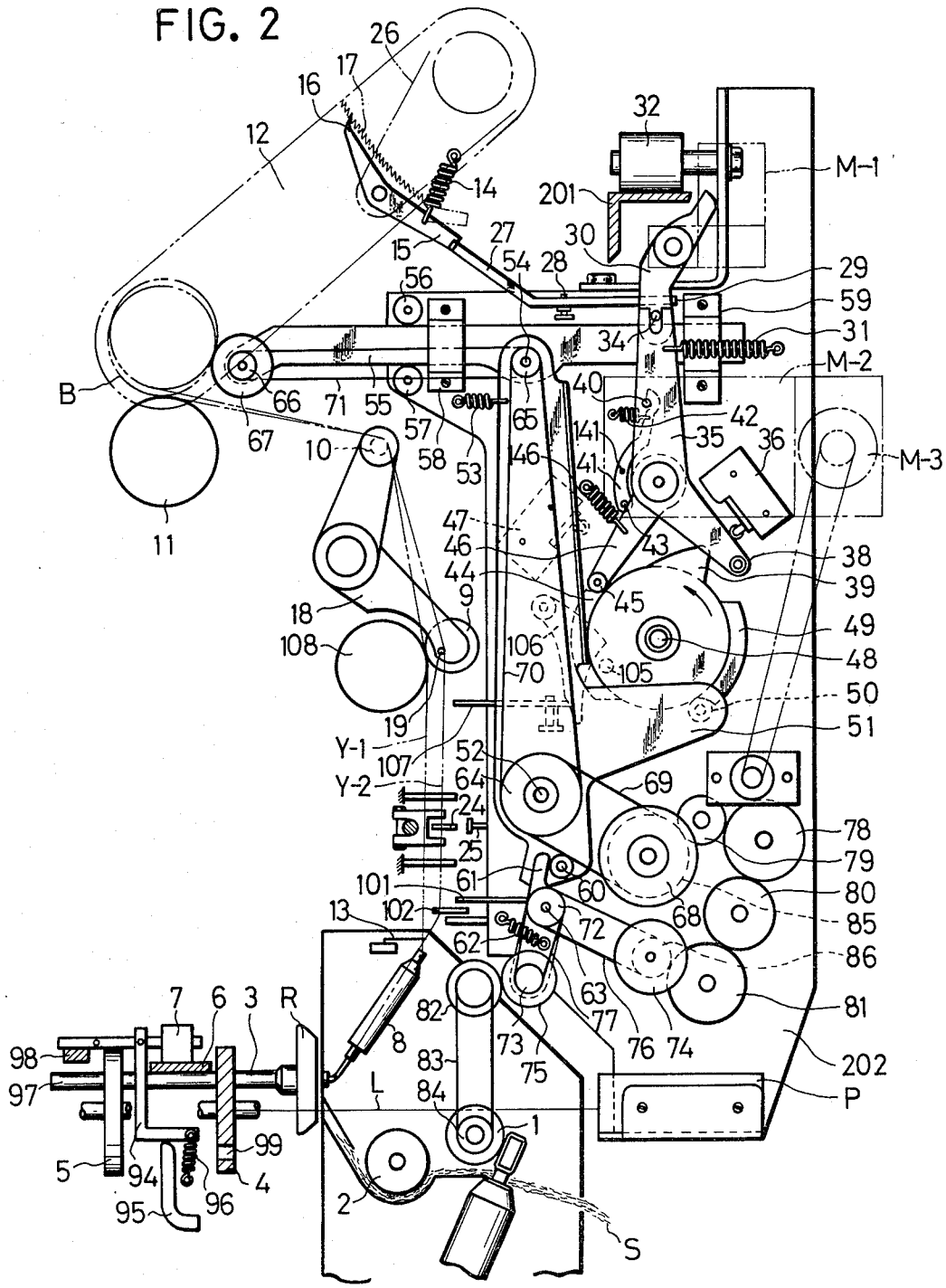
FIG. 2 is a front view of the present invention.

With this machine in which the yarn has been cut, the unit is waiting for another machine which is moving under a condition where its yarn has been arranged at another pass-way other than the usual running pass of a yarn. Since a lever 15 is fitted to the stationary bracket 26 which has been displaced by engaging with a pawl 17 of the cradle, the stop lever 27 has been in contact with the pawl 17. The stop lever 27 is designed to swing around a pin as its center, and the hook portion 29 is disengaged from the lever 30. When the hook portion 29 is disengaged from the lever 30 and the lever 30 is released, the lever 30 is pulled by a spring 31 to turn counterclockwise, as shown in FIG. 2, and the tip of the lever 30 is engaged with a notch 33. With this displacement of the lever 30, lever 35 is also displaced, and the microswitch 36 is turned OFF. Since the microswitch 36 relates to the travelling motor M-1 of the ending unit, the motor M-1 is stopped, and the driving roller 32 is also stopped. However, the ending unit is further moved by its inertial force and is stopped when the notch 37 engages with the lever 30.

While the roller 38 of the lever 35 is engaged with the cam 39 with the lever 30 displaced due to its engagement with the notch 37, another lever 41 on the frame supported by a shaft 141, and which is stopped by a pin 40 mounted on the lever 35, is turned clockwise against a spring 42. This causes the lever 46, which has been at a roller at its top in contact with a cam 44 and is pulled by a spring 146, to turn ON the switch 47. The switch 47 relates to operation of the motor M-2, which turns the camshaft 48. By rotation of the camshaft 48, the cam 49 is turned to swing the lever 51 counterclockwise around a shaft 52 as its center against a spring, as shown in FIG. 2. Since a slider 55 is, in response to the swing motion of the lever 51, transferred as guided by the guide rollers 56 and 57, and the slider bearings 58 and 59 toward the left in FIG. 2, and a friction roller 67 mounted at the top of the slider 55 comes into contact with the bobbin 13, which is lifted up by said drum 11. Further, the lever 61 is swung by a spring 62 around the shaft 63 as the center of swing motion, the lever 51 is provided with a roller 60, and the friction roller 75, pivoted at the tip of the lever 61 is in contact with the roller 82, which is connected with the feed roller 1. The pulleys 64 and 65 are provided for on the lever 51; the pulley 60, on the slider 55; the friction roller, on the shaft the same as for the pulley 66; the belts 69, 70, and 71 are respectively fittec between the pulleys 68 and 64, pulleys 64 and 65, and pulleys 65 and 67. The lever 61 is provided with pulleys 72 and 73, and on the shaft, the same as for the pulley 73, a friction roller 75 is mounted. Also, the belts 76 and 77 are respectively fitted between the pulleys 72 and 74, and pulleys 72 and 73. Therefore, the motor M-3, which will be described later, can turn the pulleys 68 and 74 through the gear wheels 78, 79, 80 and 81, can rotate the bobbin B through the friction rollers 67 and 75, and can drive the feed roller 1 through the roller 82, belt 83, and pulley 84. The lever 61 is provided with a rod 101 to keep the yarn removed from the feeler 13, and the rod 101 swings as interlocked with the swing motion of the lever 61.

Figure 1:
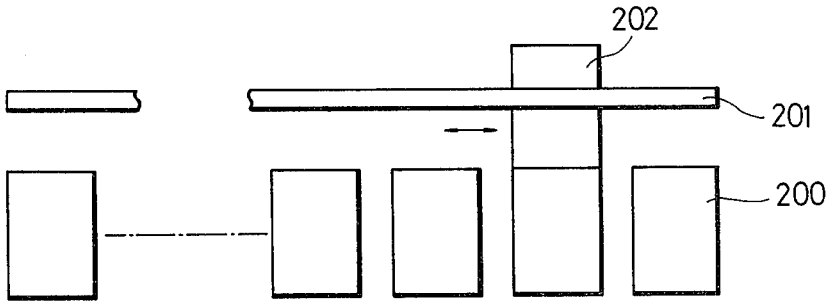
FIG. 1 is an explanation drawing of a general arrangement of a movable ending unit in connection with a fine spinning machine.
Figure 3:
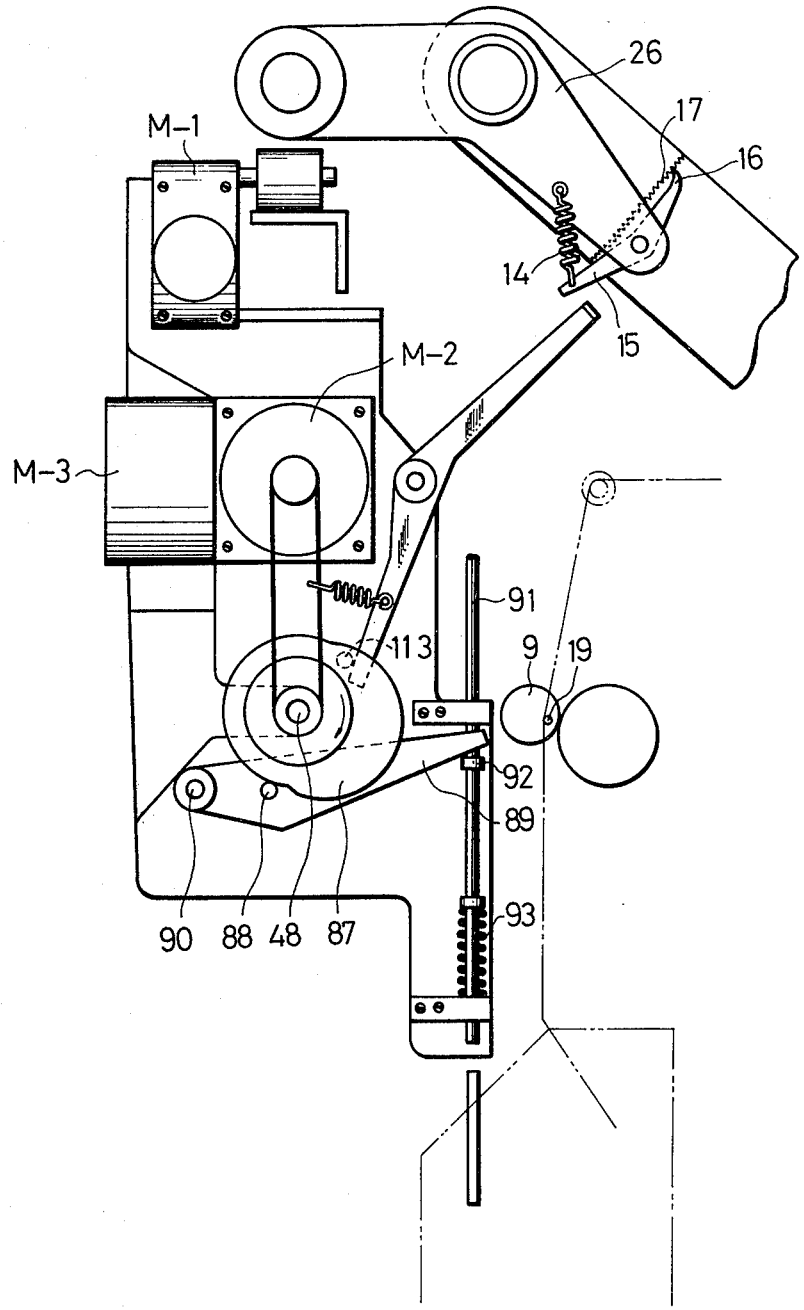
FIG. 3 is a rear view of the present invention.
Figure 7:
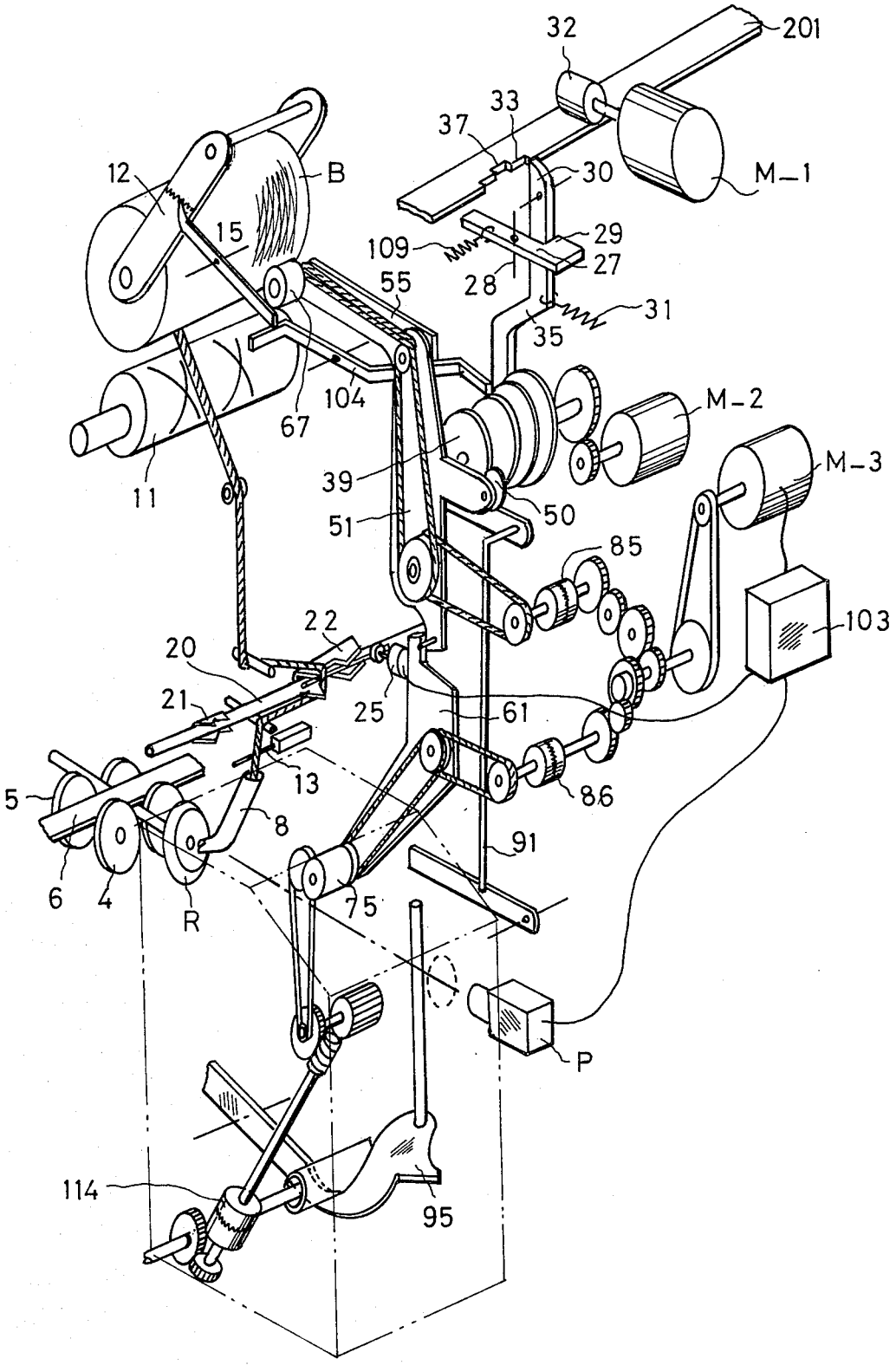
FIG. 7 is an illustrated explanation drawing of the present invention.

The lever 89 is then swung clockwise around a shaft as the center of the swing motion, as shown in FIG. 3, through a pin 88 by rotation of a cam 87 mounted on the camshaft 48, and a rod 91 is pushed down against a spring 93 through a collar 22 mounted on it to push down the lever 95. With the movement above, the brake lever 94, shown in FIG. 1, is raised against a spring 96 to release the tension pulley, depressing the belt 6 onto the rotor shaft 97, and at the same time, depresses the brake shoe 98 onto the shaft 97. As a result, the rotor R is immediately stopped. Further, rotation of the cam 87 causes the brake lever to release, and the rotor R is started to rotate and is accelerated again by the belt 6.

Figure 4:
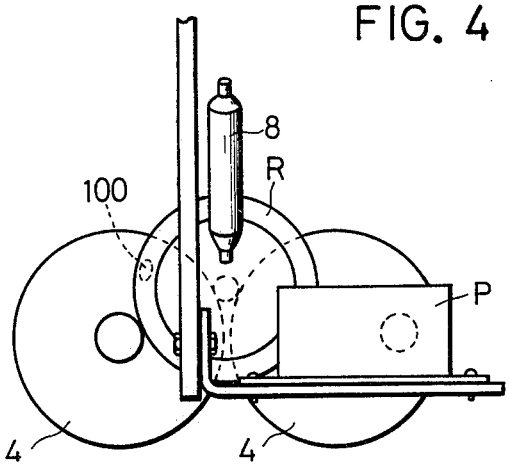
FIG. 4 is a front view of the detecting unit included in the present invention.

Increase in the number of rotations of the rotor R is monitored by a photoelectric detector P so that the detector P emits a beal L toward a reflector mirror L mounted on a rotating disc 4 constituting a bearing of the rotor R, and the reflected beam from the mirror serves to monitor the number of revolutions. It is natural for the reflector mirror not to be limited to the disc 4, but may be located anywhere at periphery 100 of the rotor R, which is indicated by dotted lines, in FIG. 4.

The number of revolutions of the rotor R monitored by the photoelectric detector P is transmitted into a controller 103, and a variable-speed motor M-3 is turned at a revolution number in proportion to that of the rotor R. As soon as the revolutions of the rotor R reaches, for example, 3,000 rpm, which is able to spin yarn, a solenoid 25 is energized by means of a signal from the detector P to push the lever 24, and the yarn Y is removed from the hook 22, is released from its bent condition, and, by reduced pressure in the rotor R, is inserted in the rotor R through a spinner 8. A clutch 86 on the pulley, 74 to rotate the feed roller 1, is then engaged at a time lag provided with a timer having the well-known function to supply a sliver S, and at a further time lag, a clutch 85 on the pulley 68, to turn the bobbin B, is engaged to start and accelerate the bobbin B and the feed roller 1, to perform winding operation after spinning. As soon as the number of revolutions of the rotor R reaches, for example, 60,000 rpm, which is its normal speed, the lever 104 is swung by the pin 113 of a cam 8 in connection with its rotation, is in contact with a pawl lever 15, and places a bobbin B on the drum during rotation, and clutch 114 of the feed roller 1 is engaged. The clutch 114 may be operated, for example by use of a microswitch operable by a lever 94 or brake lever 95 and by use of a timer having the well-known function to provide a time lag from the stopping of the rotor R. By further rotation of the cam 40, the lever 51 is displaced, the friction rollers 67 and 75 are separated from each other, and the lever 102 also departs from the yarn. With departure of the lever 102 from the yarn, the yarn is hooked to a feeler 13. Further, the levers 106 and 107 are swung by the pin 105 on a cam 39 to remove the yarn from the pin 19 to drop it onto the bottom roller 108, and the yarn is smoothly nipped, with its tension, by means of a nip-roller 9 and the bottom roller 108. At that time, a switch or timer — not illustrated — turns OFF the motor M-3, and the clutches 85 and 86 are both disengaged.

Since the lever 39 is displaced by further rotation of the cam 39, the lever 30 which has been in contact with the rail E, is also returned to its original position, a lever 27 is swung by a spring 109 to be in contact with the lever 27, a microswitch 36 is turned ON to start the motor M-1 to operate, and the ending unit starts to run. When said lever 35 is displaced, the lever 46 tends to be displaced to its original position, but it is not immediately displaced, because a roller 45 is overridden on a cam 44, and is allowed to return there by rotation of the cam 44, as soon as the lever 35 is completely returned to its original position by rotation of the cam 44 to turn OFF a microswitch 47 to stop the motor M-2 for rotating the camshaft 48.

What is claimed is:

1. An ending unit provided for an open-end fine spinning machine which spinning machine includes a rotor, which ending unit is intended to perform ending by means of the ending unit running in front of the machine, which ending unit further includes a friction roller for driving a package and a friction roller for driving a feed roller, means operably associated with each of the rollers for moving the rollers forward and backward independently, and two variable speed motors, each of which is connected to one of the rollers for driving one of the rollers, wherein said ending unit is provided with a control system operably associated with the variable motors for controlling revolutions of both the variable motors in response to rotations of the rotor in the fine spinning machine and wherein said spinning machine is provided with a hook for holding one end of a yarn string in a bent condition, and said ending unit comprises a solenoid for releasing the yarn string from said hook by kicking the hook, which solenoid is energized by output from said control system.

2. An ending unit provided for an open-end fine spinning machine which spinning machine includes a rotor, which ending unit is intended to perform ending by means of the ending unit running in front of the machine, which ending unit further includes a friction roller for driving a package and a friction roller for driving a feed roller, means operably associated with each of the rollers for moving the rollers forward and backward independently, and two variable speed motors, each of which is connected to one of the rolers for driving one of the rollers, wherein said ending unit is provided with a control system operably associated with the variable motors for controlling revolutions of both the variable motors in response to rotations of the rotor in the fine spinning machine and wherein said spinning machine is provided with a reflector mirror mounted on the rotor or on a rotating disc supporting the rotor of the fine spinning machine, and said unit is provided with a photoelectric device for emitting a beam toward said reflector mirror and receiving the beam reflected by the mirror to control revolutions of said two variable speed motors in response to rotations of the rotor in the fine spinning machine.

3. An ending unit provided for an open-end fine spinning machine which spinning machine includes a rotor, which ending unit is intended to perform ending by means of the ending unit running in front of the machine, which ending unit further includes a friction roller for driving a package and a friction roller for driving said roller, means operably associated with each of the rollers for moving the rollers forward and backward independently, and two variable speed motors, each of which is connected to one of the rollers for driving one of the rollers wherein said spinning machine is provided with a first lever which is in contact with a cradle supporting a package and holding it apart above a surface of the driving drum of the machine, and a second lever which is fitted to the ending unit for kicking the first lever to disengage the contact between the first lever and the cradle to drop the package onto the surface of the driving drum and wherein said ending unit is provided with a stop lever for stopping the motor which runs the ending unit when the stop lever is in contact with the second lever supporting said cradle upward.

4. An ending unit as claimed in claim 3, wherein said two friction rollers are mounted on arms for swinging by cam means rotatable in response to the movement of said stop-lever to cause said two friction rollers to be in contact with the package and the roller, for driving the feed roller.

* * * * *